United States Patent [19]

Lualdi

[11] Patent Number: 4,932,101

[45] Date of Patent: Jun. 12, 1990

[54] HINGE FOR MOTOR VEHICLE DOOR

[75] Inventor: Gabriele Lualdi, Fagagna, Italy

[73] Assignee: SPERRI Sperimentazione e Ricerca Srl, San Daniele Del Friuli, Italy

[21] Appl. No.: 335,959

[22] Filed: Apr. 10, 1989

[30] Foreign Application Priority Data

Apr. 19, 1988 [IT] Italy ..... 83368 A/88

[51] Int. Cl.[5] ..... E05D 7/10

[52] U.S. Cl. ..... 16/255; 16/261; 16/266; 16/272; 16/303; 16/308; 16/334; 16/344; 16/347; 16/374; 16/387

[58] Field of Search ..... 16/254, 255, 260, 263, 16/265, 296, 303, 307, 308, 334, 344, 387, 261, 266, 270, 271, 272, 347, 374

[56] References Cited

U.S. PATENT DOCUMENTS

| | | | |
|---|---|---|---|
| 3,969,789 | 7/1976 | Wize | 16/334 |
| 4,700,983 | 10/1987 | Kinaga et al. | 16/308 |
| 4,720,895 | 1/1988 | Peebles | 16/264 |
| 4,765,025 | 8/1988 | Salazar | 16/261 |
| 4,800,623 | 1/1989 | Brockhaus | 16/254 |
| 4,807,331 | 2/1989 | Calucci | 16/308 |

FOREIGN PATENT DOCUMENTS

| | | | |
|---|---|---|---|
| 1018711 | 10/1977 | Canada | 16/334 |
| 292296 | 11/1988 | European Pat. Off. | 49/381 |
| 3605434A1 | 2/1986 | Fed. Rep. of Germany . | |
| 3723415A1 | 7/1987 | Fed. Rep. of Germany . | |
| 1071203 | 6/1967 | United Kingdom | 16/308 |
| 1389466 | 4/1975 | United Kingdom | 16/308 |
| 2039592 | 8/1980 | United Kingdom | 16/308 |
| 2199072 | 6/1988 | United Kingdom | 16/254 |

*Primary Examiner*—Richard K. Seidel
*Assistant Examiner*—Edward A. Brown
*Attorney, Agent, or Firm*—Nixon & Vanderhye

[57] ABSTRACT

A hinge is provided between bodywork and a door of a motor vehicle. A stationary bracket is fixed to an upright of the bodywork and includes a base with a hole. A movable bracket is fixed to the door and a pin connects the stationary and movable brackets. A torsion bar has a wheel/cam follower for engagement with a cam on a connection element. The stationary bracket, torsion bar, cam follower and connection element comprise a sub-assembly and the cam and cam follower are located intermediate the height of the hinge. The movable bracket includes a boss with an opening. Upon linear movement in a direction parallel to the hinge axis, the boss may be disposed about the pin with a connection element and movable bracket cooperable to prevent relative rotation therebetween whereby accurate assembly is achieved.

12 Claims, 6 Drawing Sheets

HINGE FOR MOTOR VEHICLE DOOR

This invention concerns a hinge suitable for fitting to the door of a motor vehicle.

To be more exact, the invention concerns a hinge provided with a device suitable to enable the door of a motor vehicle to be resiliently clamped in various positions with a gentle movement of the door.

The invention concerns also a process for the automatic assembly of a motor vehicle door by a robot to the bodywork of the motor vehicle by means of such hinge.

The invention is applied mainly in the field of the motor vehicle industry.

Two basic types of hinge for motor vehicle doors are known essentially in the state of the art.

A first type of hinge comprises a generally U-shaped bracket, the base of which is secured to an upright forming an integral part of the bodywork of the motor vehicle, whereas the two arms of the bracket contain through holes.

A second bracket is secured to the door of the motor vehicle and is equipped with a protrusion intended to be introduced between the arms of the U-shaped bracket and with a through hole, which in its working position is aligned with the through holes contained in the arms of the bracket firmly secured to the upright of the bodywork.

This hinge can be equipped also with a device able to hold the door at a plurality of pre-determined open positions arranged, for instance, at 40°, 60° or 75° in relation to the closed position of the door; this device generally comprises an element bearing a cam surface and a torsion bar which urges the hinge permanently in a pre-determined direction.

When assembly takes place, the bracket firmly secured to the door is introduced between the arms of the U-shaped bracket fixed to the bodywork of the motor vehicle and the two brackets are coupled together with a threaded bolt joint or the like.

Although this type of hinge is satisfactory from a mechanical point of view, it is not compatible with automatic assembly of the door on the bodywork by a robot and therefore cannot be used in mass production of motor vehicles owing to questions of time and therefore of economy.

A second type of hinge employed in motor vehicles recalls the type normally used on the doors of houses. In fact, the upright connected to the bodywork of the motor vehicle bears a bracket containing a vertical pin, whereas the door of the vehicle is equipped with a bracket including a blind socket, which is positioned on the pin of the other bracket during assembly.

Mechanical blocks may be provided which permit the pin to be inserted into the socket (and also the disengagement of this connection) only at a pre-determined three-dimensional position coinciding, for instance, with a given rotation in relation to the closed-door position.

This second type of hinge lends itself readily to the automatic assembly of the door with the bodywork of the motor vehicle by means of a robot since the door in this way has merely to be lifted, rotated and fitted onto the pin secured to the bodywork.

However, this type of hinge is incompatible with the simultaneous inclusion of the door-clamping device, which therefore has to be fitted separately, with an obvious waste of materials, time and expenses.

DE-OS-3605434 envisages a hinge for motor vehicle doors in which a first portion of the hinge is connected in a known and stable manner to the door of the motor vehicle, whereas the second portion of the hinge is secured to the door frame of the bodywork in such a way that it can be removed and fitted once more in a pre-set position by means of a fixture element which can be anchored to the door in a stable manner and by means of at least one removable connection means, whereby on the second portion of the hinge and on the fixture element are arranged reciprocal guide means to align the axis of the hinge at a pre-determined position in the connection of the second portion of the hinge to the fixture element and whereby the guide means are positioned offset from the depth of the hinge and are aligned parallel to the axis of the hinge, whereas the connection means are positioned transversely to the axis of the hinge.

Moreover, the fixture element and the second portion of the hinge have essentially flat reciprocal contact surfaces which are aligned parallel to the axis of the hinge and are penetrated by the connection means, while the guide means are formed by an extension of the axis of the hinge and in particular of the pivot of the hinge, which rises above the height of the hinge in connection with a hole in a protrusion of the fixture element, the protrusion being arranged transversely to the abutment plane of the second portion of the hinge.

This hinge is complex and hard to assemble automatically and requires of necessity the employment of at least one bolt to connect in a stable manner the portion secured to the door to the actual hinge itself.

Moreover, the hinge requires a great number of components and an arm between the two elements anchored respectively to the door and to the upright of the bodywork of the vehicle. Besides, the resulting dimentions of the hinge make it unpractical and unsightly.

The present invention has the purpose of avoiding the shortcomings and drawbacks typical of the known hinges and of providing, therefore, a hinge which unites the advantages of the known hinges and eliminates their shortcomings, is therefore capable of being used in an automatic assembly line employing robots and is equipped, at the same time, with a door-clamping device which permits a gentle movement and clamping of the door at a plurality of pre-determined positions.

This is obtained with a motor vehicle door hinge possessing the features of the main claim. The dependent claims describe preferred forms of embodiment of the invention.

Moreover, the claim regarding the process defines an automatic process with a robot to assemble the doors to the bodywork of motor vehicles by means of such hinge.

In a preferred form of embodiment the hinge according to the invention comprises a stationary bracket suitable to be fixed solidly to the upright on the bodywork of the motor vehicle.

This stationary bracket is L-shaped, and an arm of this bracket bears at one end a pin intended to be the axis of rotation of the door and to cooperate with a socket machined in the bracket fixed to the door. On this pin there rotates also a cam, which during assembly is solidly fixed to the bracket borne on the door.

Moreover, the stationary bracket is equipped with a protrusion containing a slot and intended to guide a torsion bar inserted in the slot itself and connected to a camfollower which cooperates with a rotary cam coaxial with the pin The stationary bracket thus comprises two elements, namely the bracket itself and a torsion bar.

According to a variant it comprises three elements, namely the bracket itself, the torsion bar and the pin.

A cam, which is normally solidly fixed to the pin, is also fitted to the stationary bracket for operations of mechanized assembly.

In pre-assembly conditions, therefore, there are a preassembled unit fitted removably to the upright of the vehicle bodywork and a bracket element fitted removably to the door, the unit and the bracket element being fitted to each other during assembly, so that the bracket element fitted to the door is installed on the axis of the pin. In another preferred embodiment the L-shaped stationary bracket contains in its rear portion in contact with the bodywork of the motor vehicle a recess intended to lodge and guide a torsion bar.

The ends of this torsion bar are brought close to each other in a closed ring and inserted in this recess and cooperate with the stationary bracket by passing through a hole situated in a substantially central zone of such bracket and positioned at a right angle to the axis of the pin.

The cam and movable bracket cooperate by means of a pin/sleeve joint.

According to a variant a coupling obtained with a projection and cooperating with the movable bracket for reciprocal anchorage is included in front of the cam and coaxial with the axis of rotation of the beam. This coupling with the projection is advantageously conical and comprises abutment teeth to provide reciprocal circumferential anchorage.

By means of this variant it is possible to avoid a long displacement travel for placing the movable bracket, and therefore the door, on the pin. In fact, the pin only just protrudes beyond the projection and the travel to assemble the door is also reduced by 2 centimeters.

Moreover, the connection element and the stationary bracket comprise reciprocal abutment elements that serve to determine the maximum travel for opening the door.

In an automatic process to assemble the door with a robot, the door with the removable bracket already solidly fixed to it is therefore engaged and fitted directly on the pin borne on the stationary bracket solidly secured to the upright of the bodywork; the movable bracket is firmly anchored by means of a bolt to the pre-installed cam so as to form the preassembled unit on the stationary bracket. The hinge can now be deemed operational.

The hinge and process described above provide a plurality of advantages as compared to the state of the art, particularly as regards the simplicity of the hinge and its solidity, compactness and low cost, the reduced maintenance, ease of assembly and general economy in time and materials.

Other advantages will become clear on reading the following description of one form of embodiment of the invention given as a non-restrictive example and on examining the figures, in which:

FIG. 1 shows diagrammatically a portion of a hinge according to the invention;

FIG. 2 gives a diagram of an assembled hinge according to the invention;

FIGS. 3*a*, 3*b* and 3*c* give views from above, from the front and from the side respectively of one bracket of a hinge according to the invention;

FIGS. 4*a*, 4*b* and 4*c* give views from above, from the front and from the side respectively of the other bracket of a hinge according to the invention;

FIGS. 5, 6, 7 and 8 show from above four steps in the opening of the door of a motor vehicle with the hinge fitted;

FIGS. 9*a*, 9*b* and 9*c* show from above, from the front and from the side respectively a bracket of a hinge according to a preferred embodiment of the invention;

Figure 12:
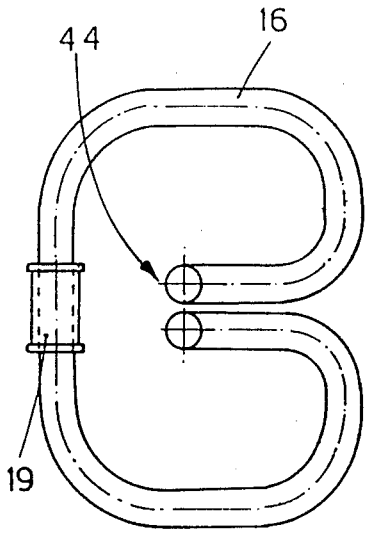
FIG. 12 shows a torsion bar suitable for use with a hinge according to a preferred embodiment of the invention.
Figure 13B:
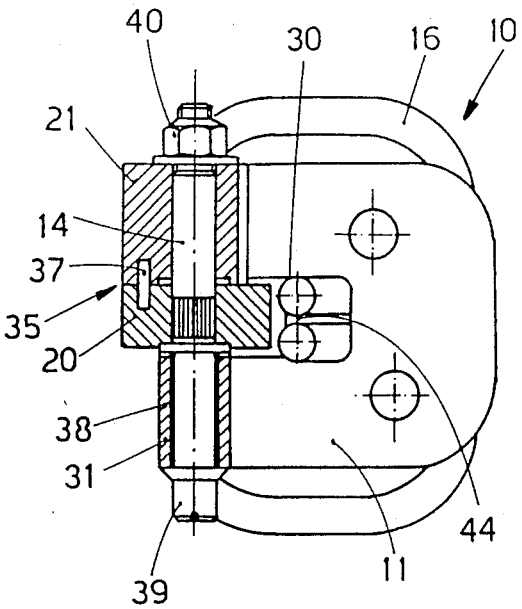
Figure 14:
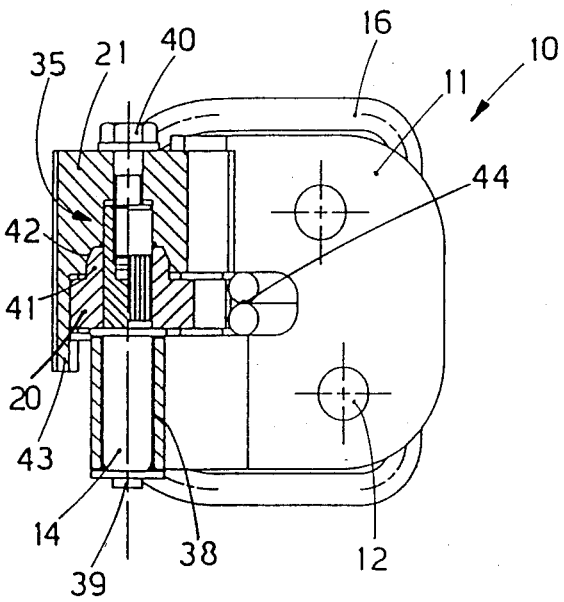
Figure 13A:
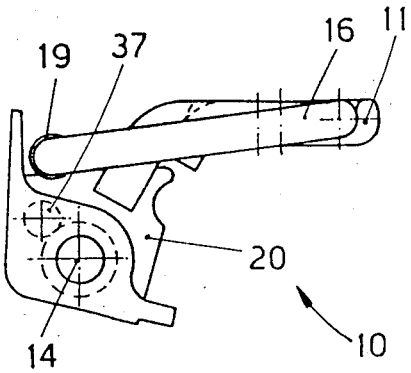

FIGS. 13*a* and 13*b* show a plan view and a section respectively of a hinge equipped with the brackets, cam and torsion bar according to FIGS. 9–12;

FIG. 14 shows a variant of the embodiment of FIG. 13*b*.

In the figures a hinge conforming to the invention bears the reference number 10.

The hinge 10 comprises a stationary bracket 11 to be fitted to an upright 24 of the bodywork 25 of a motor vehicle (see FIGS. 5–8).

The stationary bracket 11 is generally L-shaped and comprises an arm containing holes 12 able to permit the passage of elements (screws for instance) to anchor the stationary bracket 11 to the upright 24.

Figure 1:
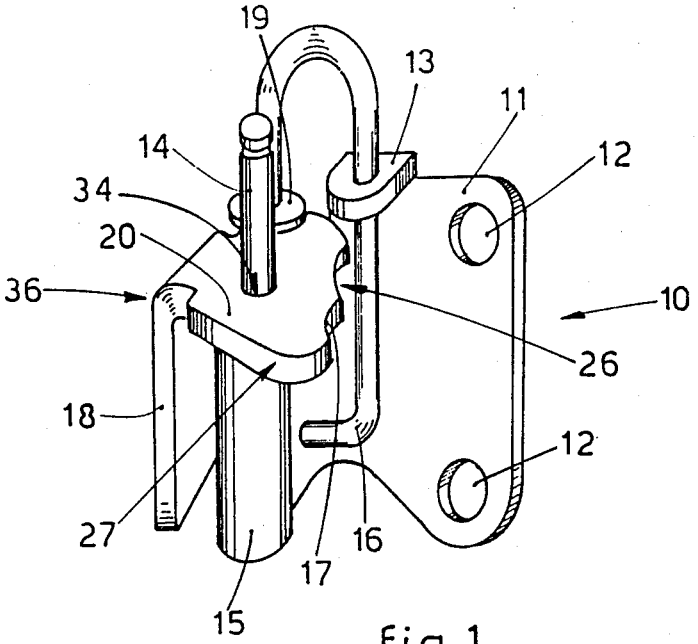
Figure 2:
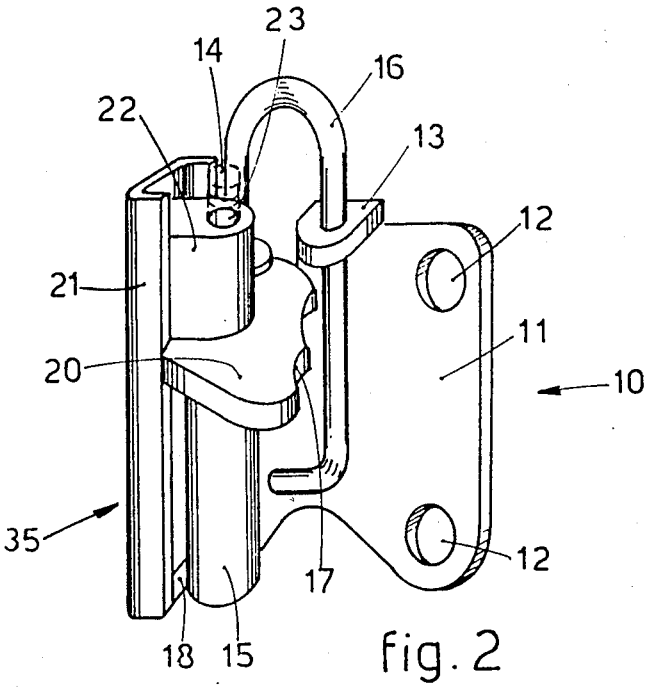
Figure 3C:
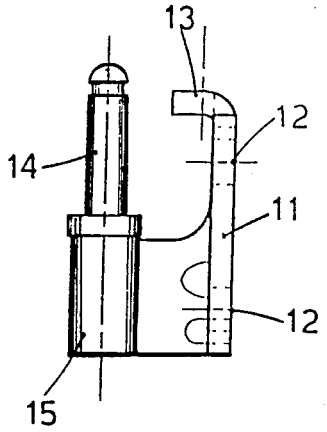
Figure 3B:
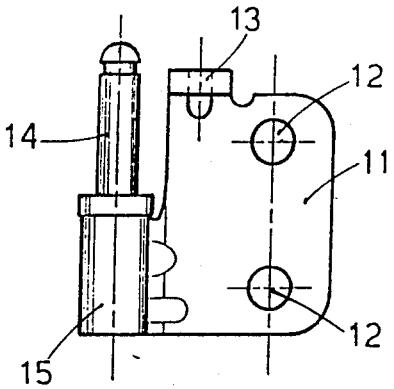
Figure 3A:
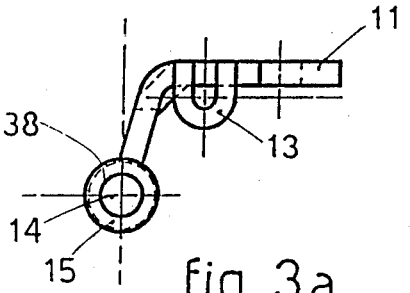
Figure 4C:
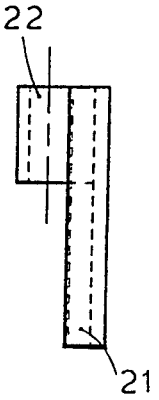
Figure 4B:
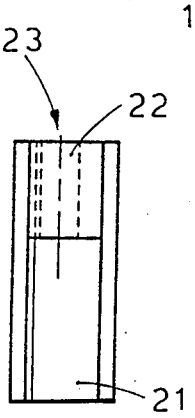
Figure 4A:
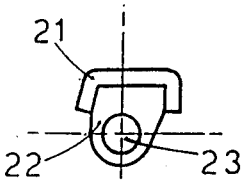

In the embodiment of FIGS. 1 and 2 the arm comprises also a protrusion containing a slot 13 located on a plane perpendicular to the plane defined by the upright 24; this slot 13 is intended to form a guide for the movement of a torsion bar 16 in a manner which will be explained hereinafter.

The other arm of the stationary bracket 11 is equipped with a supporting base 15, which forms the pivot of the hinge 10 and is provided with a hole 38 to lodge a first pivot or pin 14.

The base 15 extends along the axis of hole 38 by a portion of the height of the hinge; this portion is about equal to or less than 50% of that height.

A torsion bar 16 is secured at one of its ends in a hole contained in the stationary bracket 11 and is guided in the slot 13; it bears at its other end a wheel 19 forming a cam follower and intended to cooperate with a cam surface 17 contained on a connection element 20.

The connection element 20 consists of two arms perpendicular to each other; one of these arms contains in its face a hole 34 by means of which the connection element 20 is rotatably fitted onto the first pin 14, the lateral surface of this arm forming the cam surface 17; the other arm of the connection element 20 constitutes a guide element 18 to cooperate with a movable bracket 21 secured to the door of the motor vehicle.

The movable bracket 21 comprises a U-shaped section the arms of which define between them an accurate guide for the guide element 18 of the connection element 20.

Moreover, the base of the movable bracket 21 is equipped with a protrusion 22 which contains a through hole 23 able to cooperate with the first pin 14 of the stationary bracket 11 during assembly.

The protrusion 22 has a length of about 50% or less of the height of the hinge 10.

Before the assembly step the torsion bar 16 is threaded through the slot 13 and secured at one end to the stationary bracket 11. Thereafter the connection element 20 is fitted on the first pin 14 rotatably and the cam surface! 17 is located so as to cooperate with the cam follower 19 of !he torsion bar 16.

The torsion bar 16 is then rotated to a position where the angle between the stationary bracket 11 and guide element 18 does not have a pre-set value. The stationary bracket 11, torsion bar 16 and connection element 20 thus form one single assembly of elements firmly joined to one another.

Final assembly of the hinge 10 in the case of FIGS. 1 and 2 is carried out by threading the pin 14 into the hole 23 of the movable bracket 21 and at the same time clamping the guide element 18 laterally with the lateral fins of the movable bracket 21. This is done by lowering the protrusion 22 containing the hole 23 onto the first pin 14.

This operation causes the precise entry of the guide element 18 between the fins of the movable bracket 21.

The cooperation of the guide element 18 with the fins of the movable bracket 21 constitutes rotation-prevention reciprocal fixture means 35, which are brought into being during assembly by mere insertion of the guide element 18 and do not require bolts or other fixture means.

As a result, the connection element 20 with the cam 17 machined peripherally thereon is solidly fixed to the movable bracket 21.

The connection element 20 with its periphery formed as a cam 17 is thus located in a central position (in the direction of the height) of the hinge and is therefore in a balanced position.

The reciprocal lateral movement of the movable bracket 21 in relation to the stationary bracket 11 now causes the cam follower 19 to roll on the surface of the cam 17, which is so conformed that it ensures a gentle opening and closing and positioning of the door of a motor vehicle.

In fact, the cam surface 17 is provided also with recesses 26, which make possible a resilient clamping of the door at different angular positions, and a final mechanical clamping is caused by an abutment 27 located at the end of the cam surface 17.

The type of hinge described above enables the door of a motor vehicle to be easily installed automatically by a robot.

In fact, from the moment when the assembly formed by the stationary bracket 11, torsion bar 16 and connection element 20 forming the cam 17 is secured to the upright of the bodywork 25 of a motor vehicle, with the connection element 20 and its cam 17 located in a pre-set angular position, the robot has only to lower the door from above onto the bodywork so as to bring the movable bracket 21 into cooperation with the first pin 14 of the pre-assembled unit 36.

At the moment when the guide element 18 of the connection element 20 is introduced between the fins of the movable bracket 21, the door becomes operational, with the connection element 20 and its peripheral cam 17 in a central position.

Figure 5:
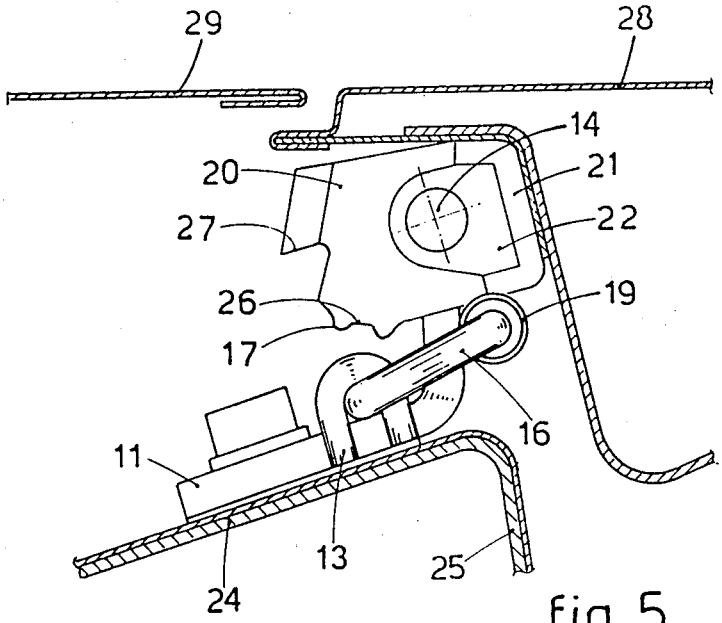

The movement to open the door of a motor vehicle is shown in FIGS. 5–8, wherein FIG. 5 shows a door 28 in the closed position (0°) alongside a mudguard 29 of the motor vehicle.

Figure 6:
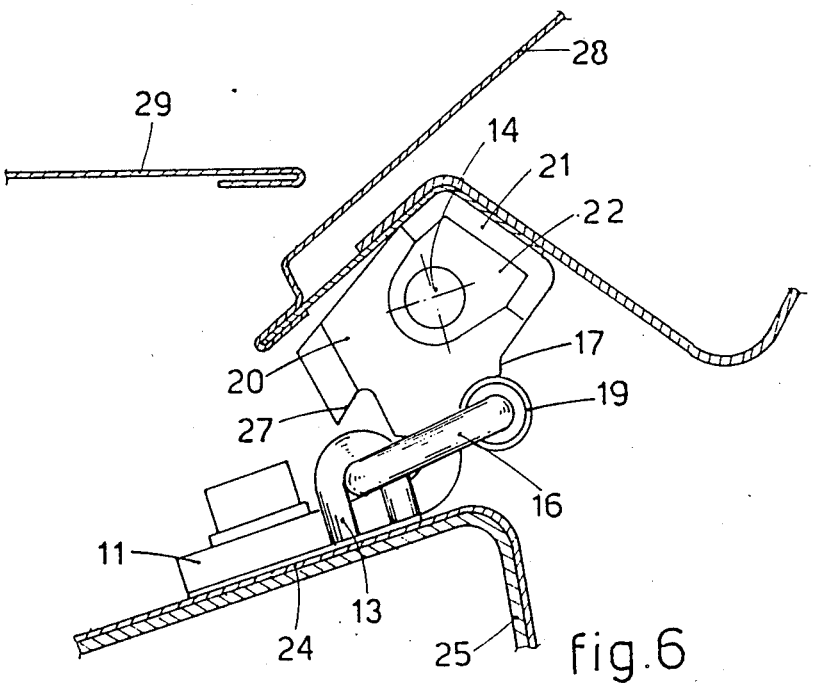
Figure 7:
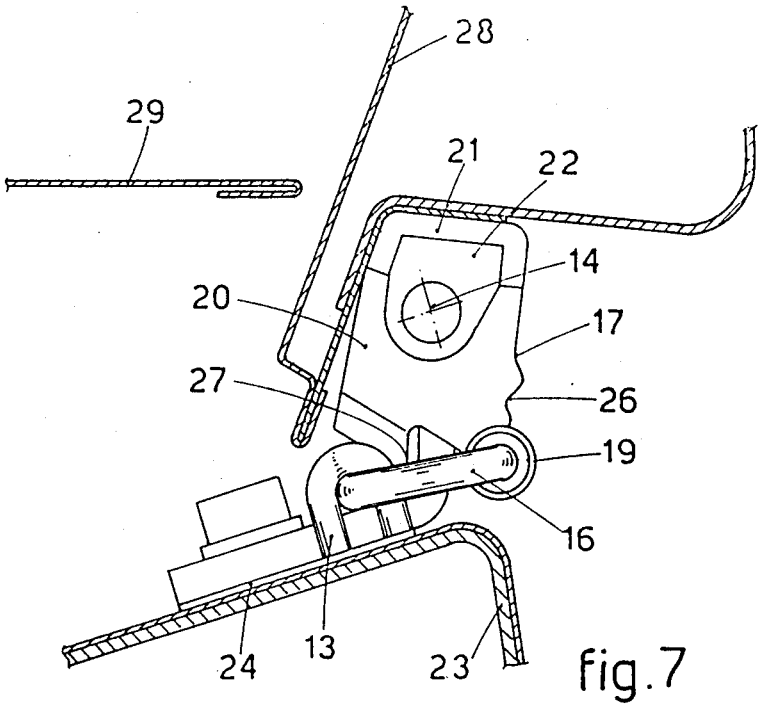
Figure 8:
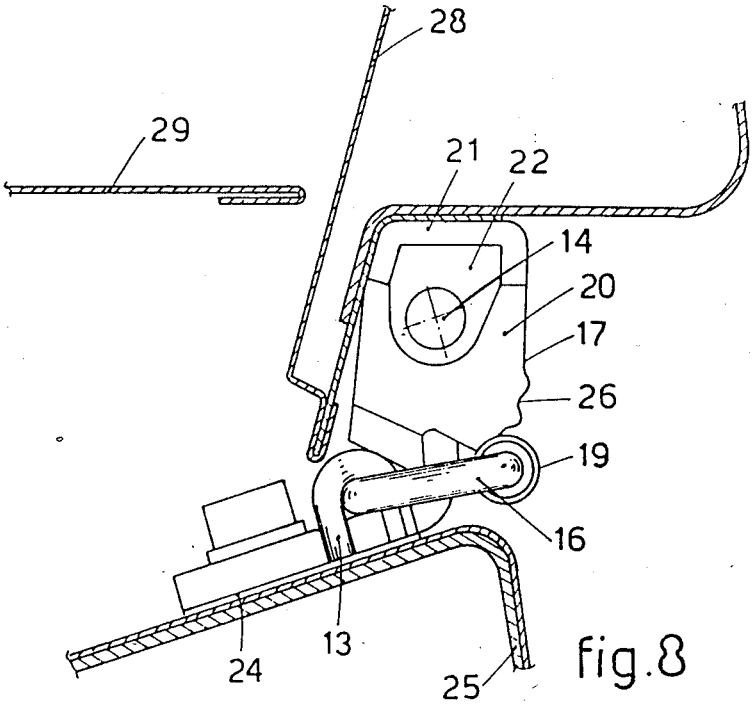
Figure 9C:
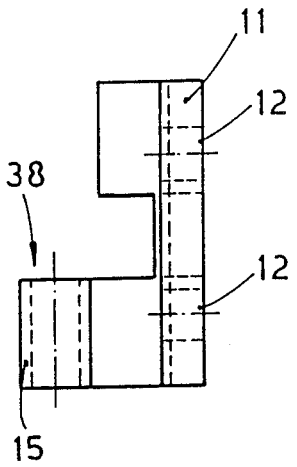
Figure 9B:
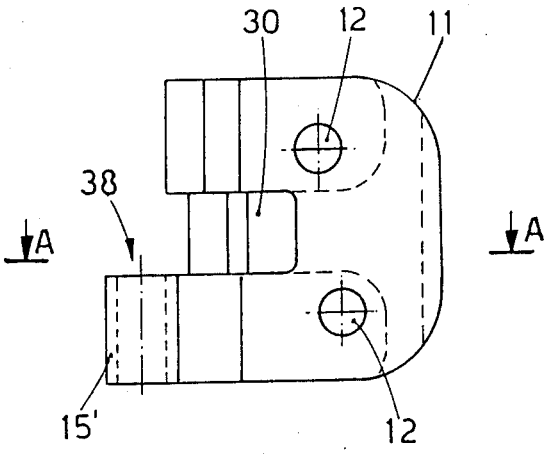
Figure 10:
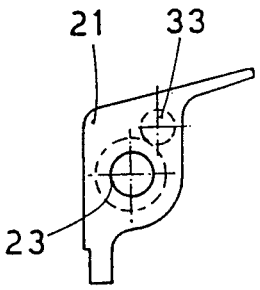
FIG. 10 shows from above a movable bracket of a hinge according to a preferred embodiment of the invention.
Figure 9A:
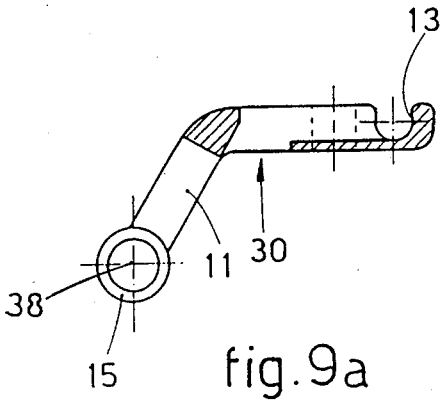
Figure 11:
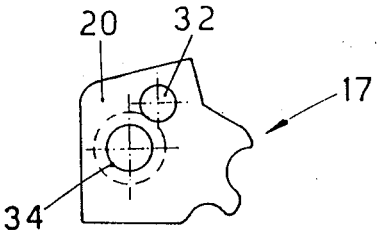
FIG. 11 shows from above a cam of a hinge according to a preferred embodiment of the invention.

The following FIGS. 6–8 show resiliently clamped positions at 40° and 70° and a mechanically clamped position at 75° respectively.

FIGS. 9 to 13 show a preferred embodiment of a hinge conforming to the invention. The hinge comprises here a stationary bracket 11 and contains holes 12 suitable to permit the passage of clamping elements.

The bracket 11 is provided with a supporting base 15 forming the pivot of the hinge and comprising a hole 38 to lodge a clamping socket 31 (see FIG. 13*b*) in which the pin 14 is fitted.

The other arm of the stationary bracket 11 contains in its rear portion a recess 13 that forms a guide for the ends brought together 44 of a torsion bar 16, these ends being positioned (see FIG. 13*b* and FIGS. 9*a*–9*b*) in a hole 32 provided in the same arm of the stationary bracket 11.

This embodiment has the effect that the anchorage of the stationary bracket 11 to the upright fixes also the torsion bar 16.

The torsion bar 16 comprises in the vertical leg of its B-shape and in a central position on that leg the wheel or cam follower 19 and, when fitted to the stationary bracket 11, extends substantially to the supporting base.

In the embodiment of FIG. 13*b* the first pin 14 is solidly fixed to the connection element 20 that includes the cam 17 on its periphery.

The connection element 20 is a plate including a hole 34 in which the first pin 14 is solidly fixed, and including also a lateral hole 32 to lodge a second reciprocal anchorage pin 37.

Cooperation between the torsion bar 16 and cam 17 takes place by means of a wheel 19, which forms a cam follower and is threaded onto the central part of the B-shaped torsion bar 16 (see FIG. 12).

The movable bracket 21 includes a hole 23 suitable to lodge the first pin 14 (see FIG. 13*b*), which is clamped there by means of a nut 40 for instance.

The movable bracket 21 includes also a lateral hole 33 that serves to lodge the second reciprocal fixture pin 37 when the hinge 10 has been installed. The second reciprocal fixture pin 37 and the holes 32 and 33 constitute rotation-prevention reciprocal fixture means 35.

The pre-assembled unit 36 consists in this case of the stationary bracket 11, which bears, solidly fixed to itself but resiliently yielding, the torsion bar 16 and cam follower 19 and comprises the first pin 14 fitted in the hole 38; owing to a clamping element 39 the first pin 14 can rotate in that hole 38 but cannot be withdrawn therefrom and is solidly fixed to the connection element 20 that bears the beam 17 on its periphery.

The connection element 20 is located at about half of the height of the hinge 10.

Final assembly takes place by inserting the first pin 14 in the hole 23 of the movable bracket 21 and by clamping it therein axially by the clamping nut 40.

FIG. 14 shows a further variant embodied to make still more simple the assembly operations so as to reduce, on the one hand, the travel for insertion of the first pin 14 in the hole 23 of the movable bracket 21 and, on the other hand, to avoid dangers arising from bad alignment.

To this end the present applicant has designed a variant of the embodiment of FIG. 13*b* whereby in the neighbourhood of the hole 34 the connection element 20 comprises a projection 41 which cooperates with a seating 42 included in the movable bracket 21.

The projection 41 advantageously includes at least one conical portion. The projection 41 and a relative seating 42 can have a polygonal or cylindrical shape; if they have a cylindrical or substantially cylindrical shape, they will comprise on their periphery one or more circumferential reciprocal contact means so that they cannot rotate reciprocally in relation to each other although they can be withdrawn.

In the embodiment of FIG. 14 the first pin 14 is solidly fixed to the connection element 20 and extends only slightly therebeyond within the movable bracket 21. This enables the insertion travel to be shortened considerably and the assembly operation to be simplified.

To improve alignment, the movable bracket 21 comprises a protrusion 23 which slides alongisde the connection element 20 and, together with the conformation of the projection and seating 41–42, prevents wrong alignment. The projection 41 and seating 42 constitute the rotation-prevention reciprocal fixture means 35.

This invention, however, is not restricted to the forms of embodiment described above but, on the contrary, incorporates many variants.

The purposes of the invention therefore include forms of embodiment in which, for instance, the first pin 14 and the connection element 20 form one single body and the pivot of the hinge is provided on the movable bracket.

Likewise, the purposes of the invention cover forms of embodiment in which the cam surface, brackets and torsion bar have geometric shapes and sizes other than those described above and shown in the attached figures but within the field of mechanical equivalences.

I claim:

1. A hinge for use between the bodywork and a door of a motor vehicle, comprising:

a first bracket for securement to one of the bodywork and the door and having a boss with an opening therein;

a sub-assembly including a second bracket for securement to the other of the bodywork and the door, said second bracket including a base projecting laterally therefrom and terminating at its upper end at an elevation intermediate the height of said hinge, said upper base end having an opening therein, an elongated pin for connecting said first and second brackets one to the other and defining a generally vertically extending hinge axis, said pin being received in the opening in said upper base end to upstand therefrom, a torsion bar secured to said second bracket, a cam follower carried by said torsion bar at an elevation intermediate the height of said hinge, and a connection element having an opening receiving said pin, said connection element having faces bearing on the upper end of said base and having a cam surface at an elevation corresponding to the elevation of said cam follower for engagement therewith to detent the brackets in predetermined angular positions about said axis relative to one another, said pin extending upwardly from said base through the opening in said connection element and upstanding from said connection element; and means cooperable between said first bracket and said connection element for preventing relative rotation between said first bracket and said connection element about an axis parallel to said hinge axis in response to relative, generally vertical, linear movement of said sub-assembly and said first bracket in a direction generally parallel to said hinge axis to engage said pin in said opening in said boss with said boss bearing on said connection element thereby forming said hinge.

2. A hinge according to claim 1 wherein said connection element includes a guide having generally vertically extending surfaces, said first bracket having generally vertically extending surfaces for engaging the vertically extending surfaces of said guide in response to said relative linear movement of said sub-assembly and said first bracket.

3. A hinge according to claim 1 wherein said connection element includes a guide, said first bracket being generally channel-shaped in the vertical direction for receiving said guide and cooperable therewith to prevent relative rotation about an axis parallel to said hinge axis.

4. A hinge according to claim 1 wherein said pin is fixed to said second bracket.

5. A hinge according to claim 1 wherein said pin is rotatable in the base opening of said second bracket, and means adjacent the lower end of said base for clamping said pin thereto, said pin and said connection element being fixed one with the other.

6. A hinge according to claim 1 wherein said relative rotation prevention means includes a second pin interconnecting said connection element and said first bracket, said second pin extending generally parallel to the first mentioned pin.

7. A hinge according to claim 1 wherein said relative rotation prevention means includes a projection and a seat coaxial with said pin and located on the bearing faces of said connection element and the boss of said first bracket, said projection and said seat comprising circumferential reciprocal contact means.

8. A hinge according to claim 1 wherein said torsion bar is generally B-shaped, said second bracket defining a hole, the ends of said torsion bar being brought together centrally and positioned in said hole and extending substantially at right angles to said pin.

9. A hinge according to claim 1 wherein said cam surface has at least one recess for receiving said cam follower to detent said brackets.

10. A hinge according to claim 1 wherein an end of said cam surface has an abutment providing a mechanical blockage to further pivotal movement of said brackets relative to one another.

11. A hinge for connecting the bodywork and a door of a motor vehicle, comprising:

a stationary bracket for securement to an upright of the bodywork, the stationary bracket including a base having a hole;

a movable bracket for securement to the door;

a first pin for connecting the stationary and movable brackets one to the other, said pin being received in the hole of said base, said movable bracket having an element having a hole for receiving said pin;

a connection element carrying a cam and having a hole for receiving said pin;

a torsion bar secured to said stationary bracket;

a cam follower carried by said torsion bar;

said connection element, said stationary bracket, said torsion bar, said cam follower and said pin forming a hinge sub-assembly, said can and cam follower being located in a central position of said hinge, said torsion bar extending approximately parallel to the supporting base of the stationary bracket, said sub-assembly being anchored to an upright of the bodywork and coupled to said movable bracket by insertion of said pin in the hole of said movable bracket, and means for preventing relative rotation of said connection element and said movable bracket in response to insertion of said pin in the hole of the movable bracket, said rotation-prevention means comprising a second pin interconnecting said connection element and said movable bracket, said second pin being located alongside and parallel to the first pin.

12. A hinge for connecting the bodywork and a door of a motor vehicle, comprising:

a stationary bracket for securement to an upright of the bodywork, the stationary bracket including a base having a hole;

a movable bracket for securement to the door;

a first pin for connecting the stationary and movable brackets one to the other, said pin being received in the hole of said base, said movable bracket having an element having a hole for receiving said pin;

a connection element carrying a cam and having a hole for receiving said pin;

a torsion bar secured too said stationary bracket;

a cam follower carried by said torsion bar;

said connection element, said stationary bracket, said torsion bar, said cam follower and said pin forming a hinge sub-assembly, said cam and cam follower being located in a central position of said hinge, said torsion bar extending approximately parallel to the supporting base of the stationary bracket, said sub-assembly being anchored to an upright of the bodywork and coupled to said movable bracket by insertion of said pin in the hole of said movable bracket, and means for preventing relative rotation of said connection element and said movable bracket in response to insertion of said pin in the hole of the movable bracket, said rotation-prevention means including a projection and a seat coaxially about said pin and located on connecting faces of said connection element and movable bracket, said projection and seat comprising circumferential reciprocal contact means.

* * * * *